US007621667B2

(12) United States Patent
Behr et al.

(10) Patent No.: US 7,621,667 B2
(45) Date of Patent: Nov. 24, 2009

(54) LIGHTING DEVICE COMPRISING AT LEAST ONE LIGHT-EMITTING DIODE AND VEHICLE HEADLIGHT

(75) Inventors: Gerhard Behr, Altheim (DE); Peter Helbig, Sontheim/Brenz (DE); Thomas Reiners, Bachhagel (DE); Ralf Vollmer, Heidenheim (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 157 days.

(21) Appl. No.: 11/666,455

(22) PCT Filed: Dec. 1, 2005

(86) PCT No.: PCT/DE2005/002169

§ 371 (c)(1),
(2), (4) Date: Apr. 27, 2007

(87) PCT Pub. No.: WO2006/066530

PCT Pub. Date: Jun. 29, 2006

(65) Prior Publication Data

US 2008/0117647 A1 May 22, 2008

(30) Foreign Application Priority Data

Dec. 22, 2004 (DE) ..... 10 2004 062 990

(51) Int. Cl.
*H01R 33/00* (2006.01)

(52) U.S. Cl. ..... 362/651; 362/294

(58) Field of Classification Search ..... 362/294, 362/651, 439, 332, 373, 640, 647, 264
See application file for complete search history.

(56) References Cited

U.S. PATENT DOCUMENTS

| | | | | |
|---|---|---|---|---|
| 3,371,202 | A | 2/1968 | Moore et al. | |
| 4,350,931 | A * | 9/1982 | Niskin | 315/72 |
| 6,268,702 | B1 | 7/2001 | Fleck | |
| 6,435,704 | B1 | 8/2002 | Montet et al. | |
| 6,598,996 | B1 | 7/2003 | Lodhie | |
| 6,773,138 | B2 * | 8/2004 | Coushaine | 362/656 |
| 6,981,793 | B2 * | 1/2006 | Behr et al. | 362/651 |
| 7,004,609 | B2 | 2/2006 | Behr | |
| 7,093,958 | B2 * | 8/2006 | Coushaine | 362/249.02 |
| 7,360,925 | B2 * | 4/2008 | Coushaine | 362/249.01 |
| 7,478,931 | B2 * | 1/2009 | Miletich et al. | 362/364 |
| 7,517,112 | B2 * | 4/2009 | Miletich et al. | 362/269 |
| 2004/0150995 | A1 * | 8/2004 | Coushaine et al. | 362/255 |
| 2004/0165387 | A1 | 8/2004 | Zhang | |
| 2004/0179368 | A1 | 9/2004 | Takeda | |
| 2004/0240228 | A1 | 12/2004 | Behr | |
| 2006/0083013 | A1 * | 4/2006 | Wanninger et al. | 362/509 |

FOREIGN PATENT DOCUMENTS

| | | |
|---|---|---|
| CN | 1450303 | 10/2003 |
| DE | 101 48 115 | 4/2003 |
| DE | 102 35 699 | 2/2004 |
| DE | 10 2004 012185 | 9/2004 |
| EP | 1 215 735 | 6/2002 |
| EP | 1 298 382 | 4/2003 |

* cited by examiner

*Primary Examiner*—Jong-Suk (James) Lee
*Assistant Examiner*—Julie A Shallenberger

(57) ABSTRACT

A lighting device includes at least one light-emitting diode (3) and a cooling aggregate (1) for cooling the at least one light-emitting diode (3), wherein the cooling aggregate (1) is provided with locking elements (17, 18, 19) adapted to form a bayonet catch with a fixing device (30) holding the lighting device. Preferably, at least one of the lighting devices is mounted as the light source in a vehicle headlight.

11 Claims, 8 Drawing Sheets

Figure 1:
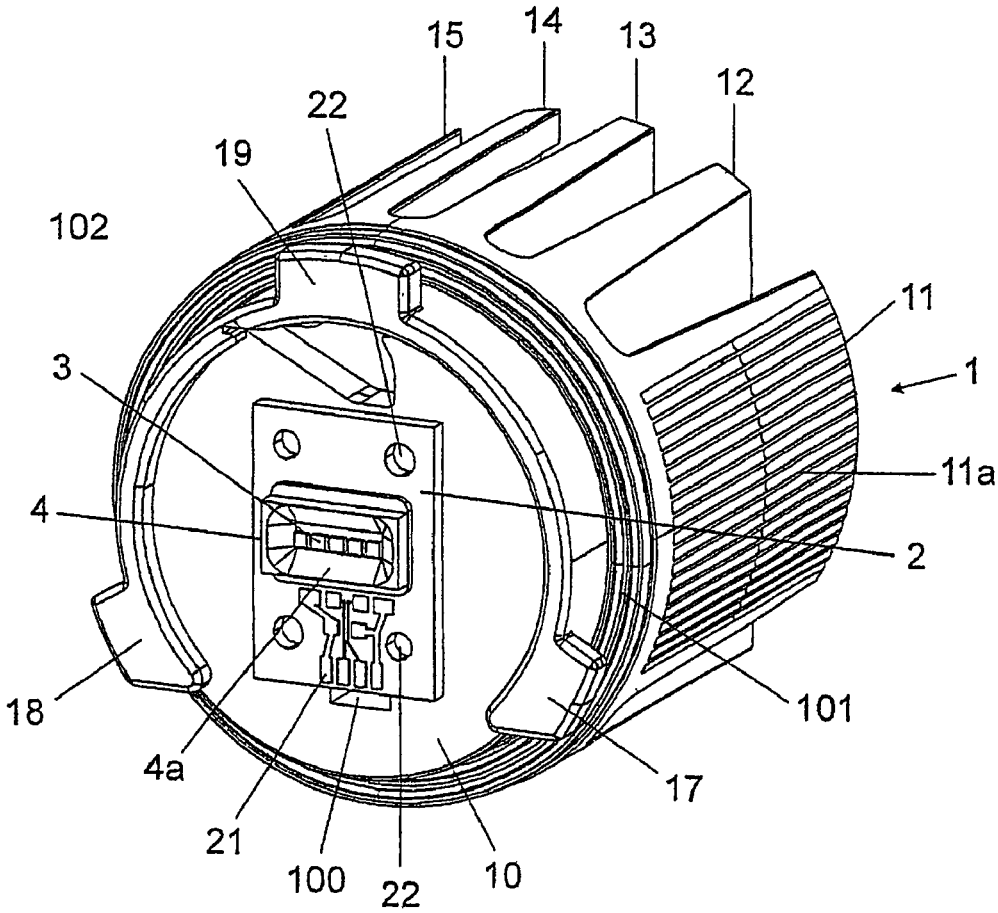

LIGHTING DEVICE COMPRISING AT LEAST ONE LIGHT-EMITTING DIODE AND VEHICLE HEADLIGHT

The invention relates to an illumination device in accordance with the precharacterizing clause of patent claim 1 and to a vehicle headlight having at least one such illumination device.

PRIOR ART

Such an illumination device has been disclosed, for example, in EP-A 1 298 382. This specification describes an illumination device having two or more light-emitting diodes which are arranged on a heat sink and optics as well as an electrical module for operating the light-emitting diodes. This illumination device is envisaged for use in a vehicle and as a replacement for a conventional incandescent lamp.

SUMMARY OF THE INVENTION

It is the object of the invention to provide a generic illumination device which makes possible reliable mounting in a vehicle headlight, with a defined physical position and alignment with respect to the headlight optics.

This object is achieved according to the invention by the features of patent claim 1. Particularly advantageous embodiments of the invention are described in the dependent patent claims.

The illumination device according to the invention has at least one light-emitting diode and a heat sink for the purpose of cooling the at least one light-emitting diode, latching means being arranged on the heat sink which serve the purpose of forming a bayonet-type lock with a holder for the illumination device. The plugging and rotary movement, which is required in the case of the bayonet-type lock for the purpose of producing the connection between the illumination device and its holder, ensures that the illumination device is fixed reliably. In addition, the bayonet-type lock may make it possible, in a relatively simple manner, possibly with few additional means, to achieve a defined installation position for the illumination device according to the invention in its holder. When the illumination device according to the invention is used in a vehicle headlight, adjustment of the light-emitting diodes or the primary optics of the illumination device with respect to the light-deflecting means of the vehicle headlight is thus made possible.

The latching means advantageously comprise at least two latching tabs which are arranged along a circular arc. As a result, at least two bearing points are formed which ensure that the illumination device is fixed stably in its holder. Three latching tabs are preferably provided which are used both as a reference for the alignment of the light-emitting diodes and the primary optics on the heat sink of the illumination device and as a reference for the alignment of the illumination device with respect to a holder or with respect to the light-deflecting means of a vehicle headlight.

In accordance with one exemplary embodiment of the illumination device according to the invention, the abovementioned latching tabs are integrally formed on a section of the heat sink with a circular-cylindrical geometry. As a result, the latching tabs, together with the heat sink, can be produced in one manufacturing step. In accordance with one alternative exemplary embodiment of the illumination device according to the invention, the latching tabs are formed as part of a fixing ring which is mounted on the heat sink. The fixing ring provides additional adjustment possibilities. In particular, the fixing ring allows for so-called five-axis or six-axis adjustment. This means that, within the reference plane defined by the latching tabs, the alignment of the light-emitting diodes or the primary optics with respect to the latching tabs can be fixed, for example, by rotating the fixing ring with respect to the heat sink about its ring axis and subsequently fixing it in this position. In addition, the installation depth of the light-emitting diodes or the primary optics in the holder for the illumination device can be set to the desired value, for example, by displacing the fixing ring along its ring axis on the heat sink and subsequently fixing it in the position. In addition, the angle between the reference plane and the carrier plate for the light-emitting diodes or the mounting surface for the primary optics of the illumination device can be set, for example, by inclining the fixing ring and subsequently fixing it in the inclined position.

At least one of the latching tabs advantageously has a shape which is different than the shape of the other latching tabs. As a result, it is possible to clearly fix the installation position of the illumination device in its holder. In addition, the shape of the latching tabs can be used for the purpose of coding different types of illumination devices by different types of illumination devices being equipped with differently shaped latching tabs.

In order to ensure a reliable clamping fit for the illumination device in its holder, a spring ring is advantageously provided which acts as an opposing bearing with respect to the latching tabs when the bayonet-type lock is latched.

In accordance with one particularly preferred exemplary embodiment of the invention, the illumination device has an electrical connection having at least one metallic contact web which extends perpendicularly with respect to the axis of the rotary movement of the bayonet-type lock, with the result that, owing to the rotary movement when the bayonet-type lock is latched or unlatched, the electrical contact between the at least one metallic contact web and its opposing contact is produced or released. As a result, at the same time as the bayonet-type lock is latched, the electrical contact is also produced between the electrical connection of the illumination device and the lampholder contacts of its power supply. In particular, no further intervention is required in order to connect the illumination device to the power supply once it has been mounted in its holder.

The illumination device according to the invention is used, for example, as a light source in a vehicle luminaire, preferably in the vehicle headlight. For example, two or more of the illumination devices according to the invention can be arranged in a holder in a vehicle headlight in order to realize light distributions for various applications. For example, parking light, daytime running light, lower beam, upper beam, foglight etc. can be realized by this vehicle headlight by switching the abovementioned illumination devices on in different combinations.

The vehicle headlight according to the invention has at least one illumination device, which is arranged in a holder of the vehicle headlight and has at least one light-emitting diode and a heat sink for the at least one light-emitting diode, and light-deflecting means for the light generated by the at least one illumination device, the heat sink being provided with first latching means which form a bayonet-type lock with second latching means on the holder. Owing to the plugging and rotary movement of the bayonet-type lock, which is required in the case of the bayonet-type lock for the purpose of producing the connection between the illumination device and its holder, reliable fixing of the at least one illumination device in its holder in the vehicle headlight is ensured. In addition, it is thus made possible to adjust the light-emitting diodes or the primary optics of the illumination device with respect to the light-deflecting means of the vehicle headlight. The light-deflecting means in the simplest case are a reflector, for example a free-form surface reflector, or an optical system having fiberoptic conductors and/or optical lenses or a combination of a reflector with such an optical system.

In the case of the vehicle headlight according to the invention, the first latching means advantageously comprise at least three latching tabs which are arranged along a circular are, and the second latching means comprise a mounting opening in the holder for the illumination device, whose rim has appropriate cutouts for the at least three latching tabs. In addition, the second latching means comprise a stop for at least one of the latching tabs, which stop serves the purpose of limiting the rotary movement when the bayonet-type lock is latched. This ensures that the illumination device is installed in the correct position in the holder (provided for this purpose) of the vehicle headlight.

The second latching means also advantageously comprise a ramp-shaped web at the rim of the mounting opening in order to prevent automatic unlatching of the bayonet-type lock.

The at least one illumination device of the vehicle headlight is advantageously provided with an electrical connection which has at least one contact web which extends perpendicularly with respect to the axis of the rotary movement of the bayonet-type lock, with the result that, owing to the rotary movement when the bayonet-type lock is latched or unlatched, the electrical contact between the at least one contact web and an opposing contact on the vehicle headlight is produced or released. As a result, no further intervention is required in order to connect the at least one illumination device to the power supply once it has been mounted in its holder.

DESCRIPTION OF THE PREFERRED EMBODIMENTS

Figure 2:
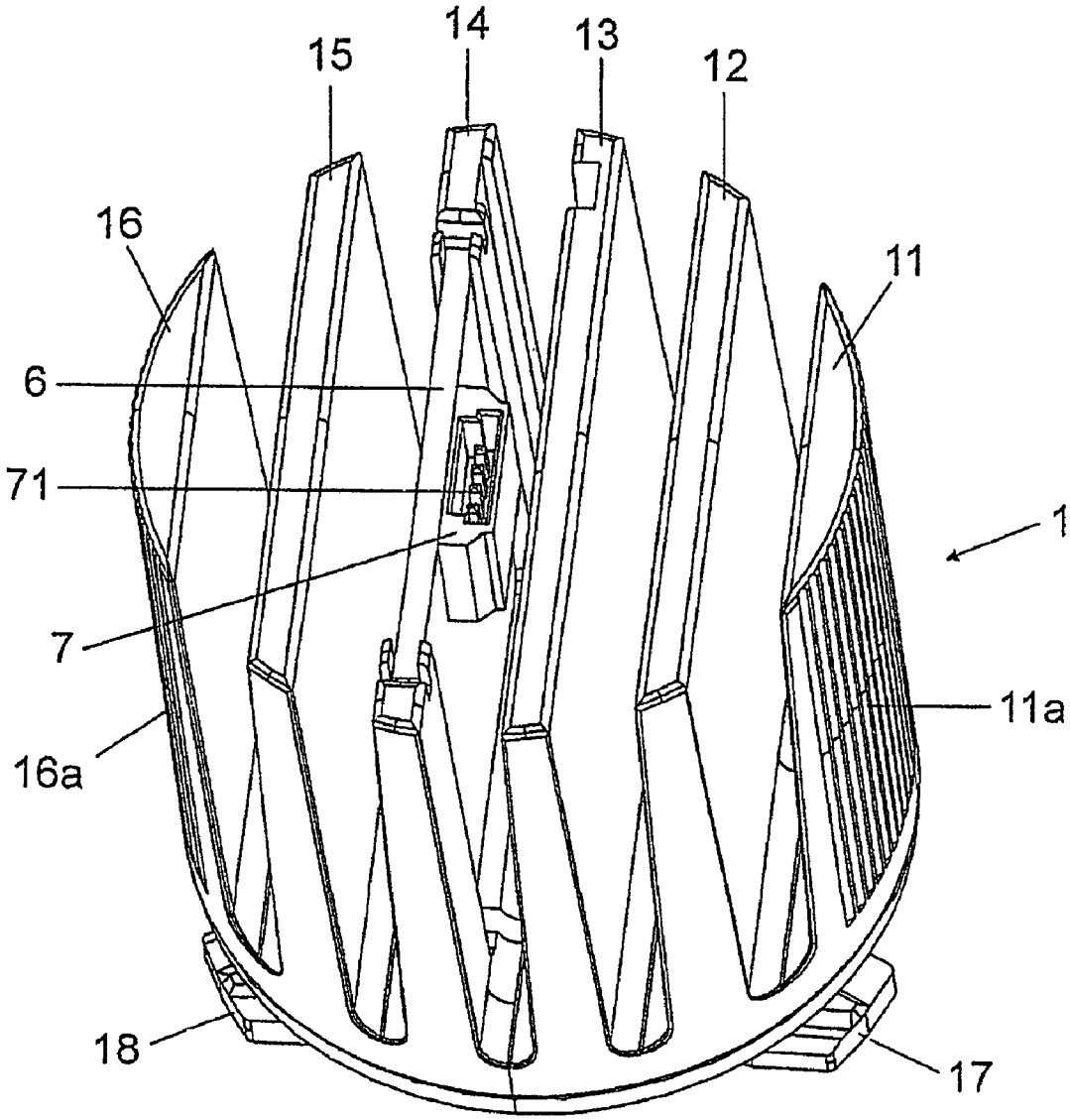
Figure 3:
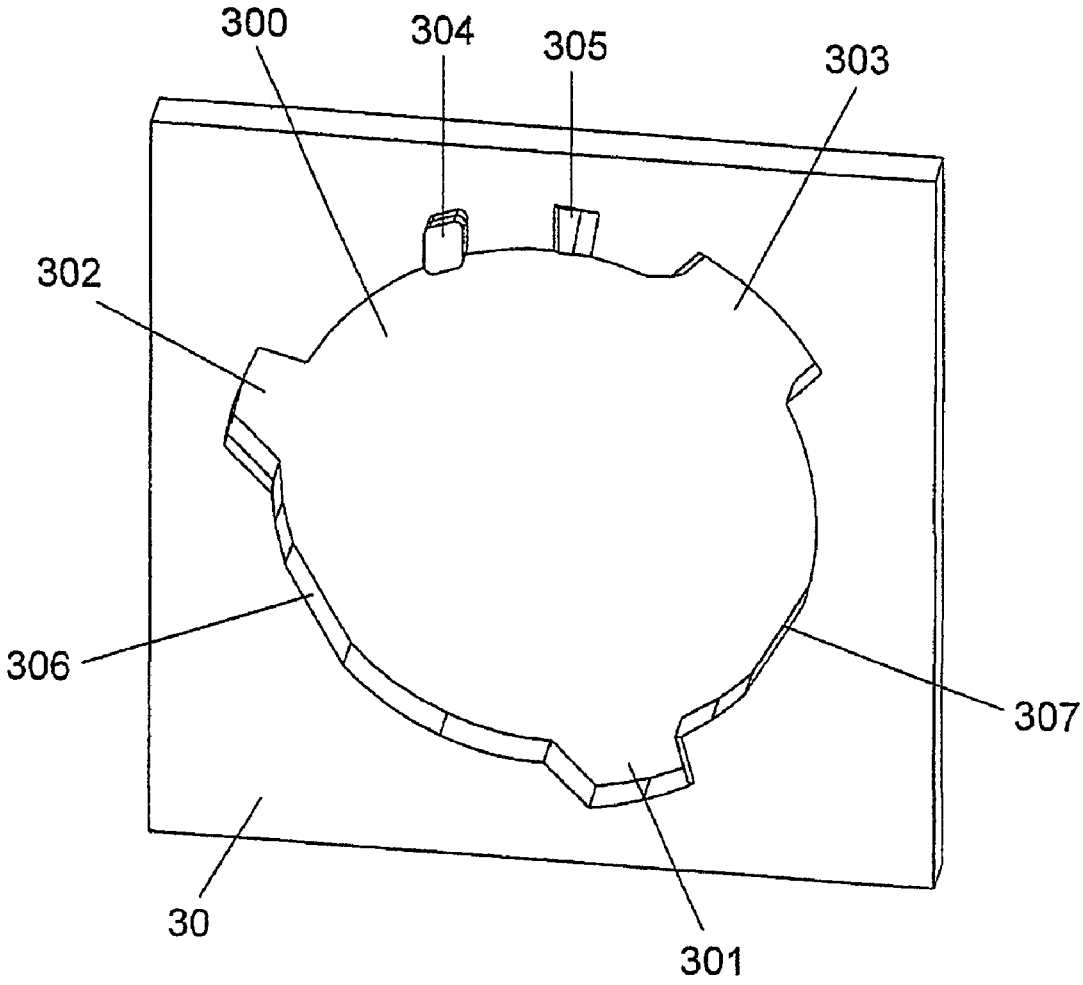
Figure 4:
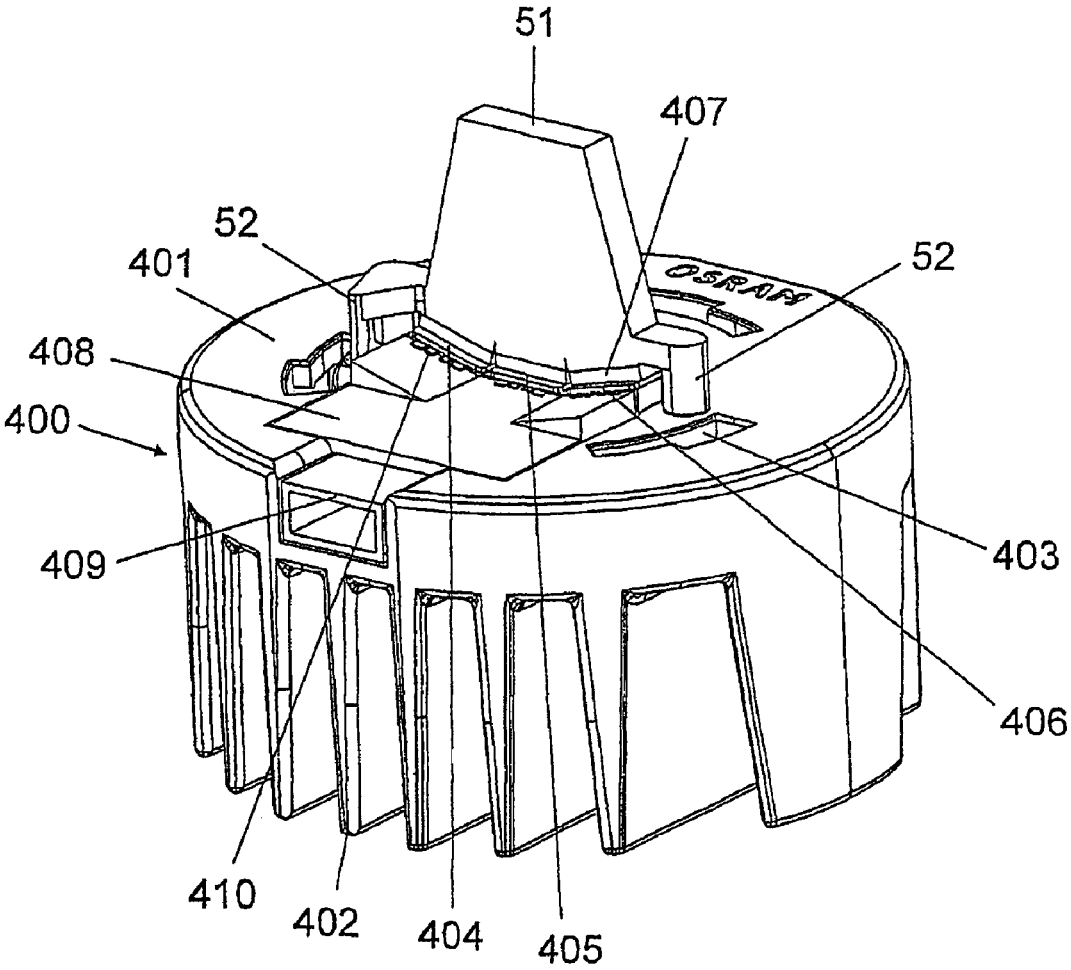
Figure 5:
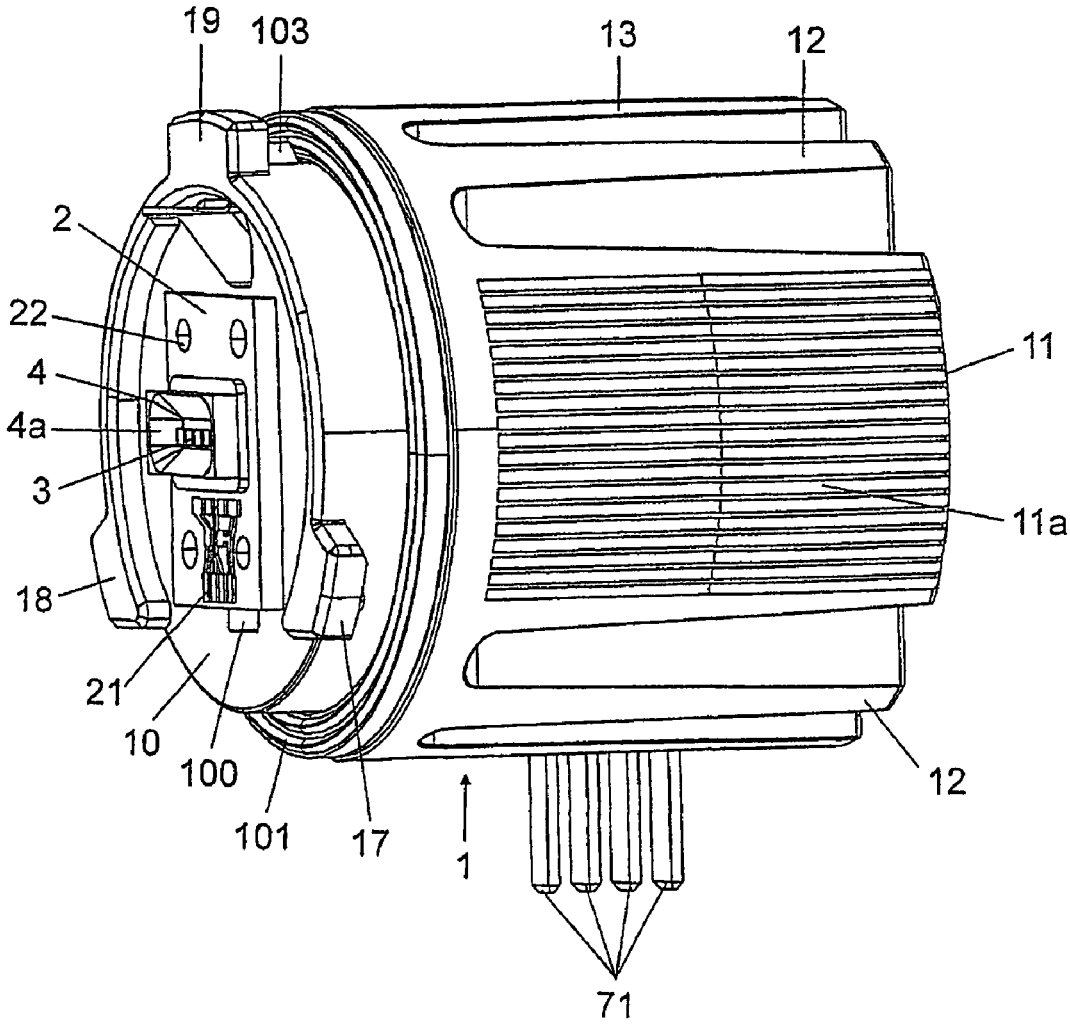
Figure 6:
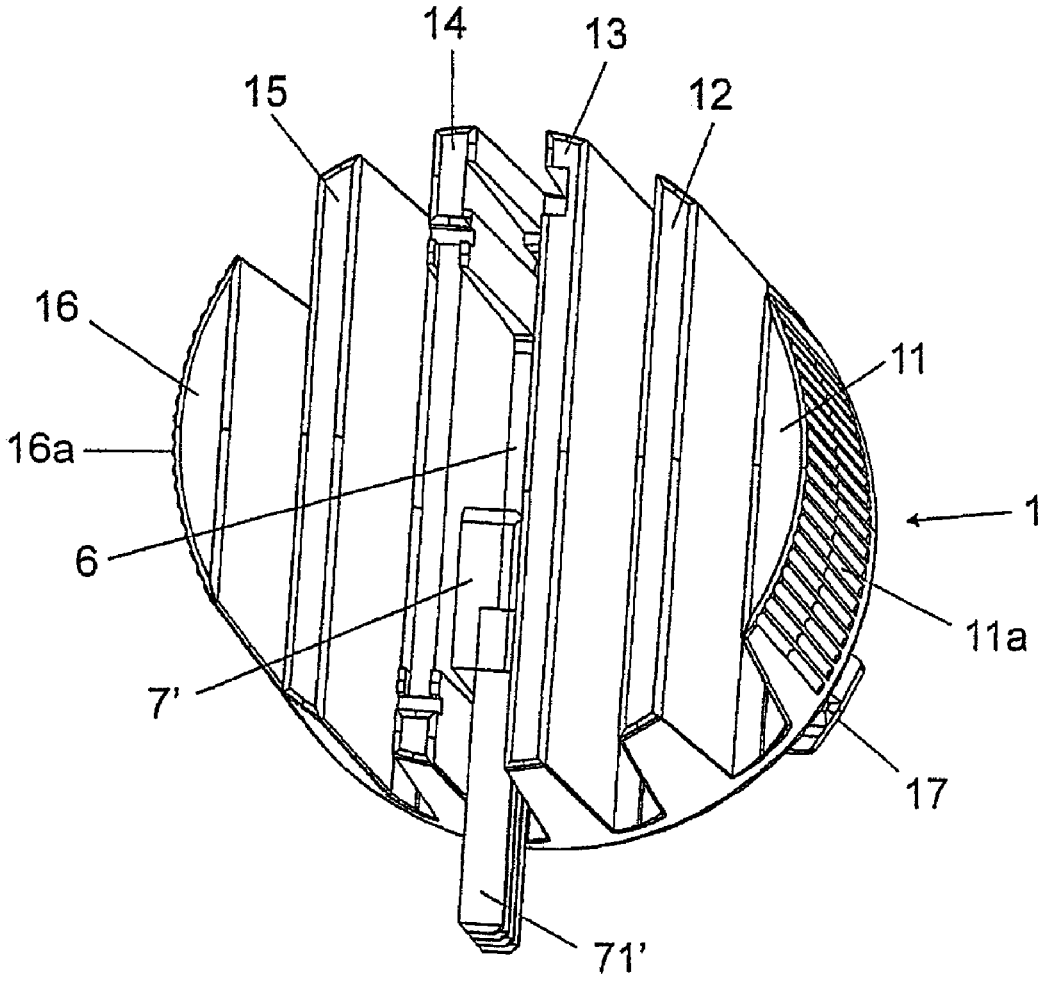
Figure 7:
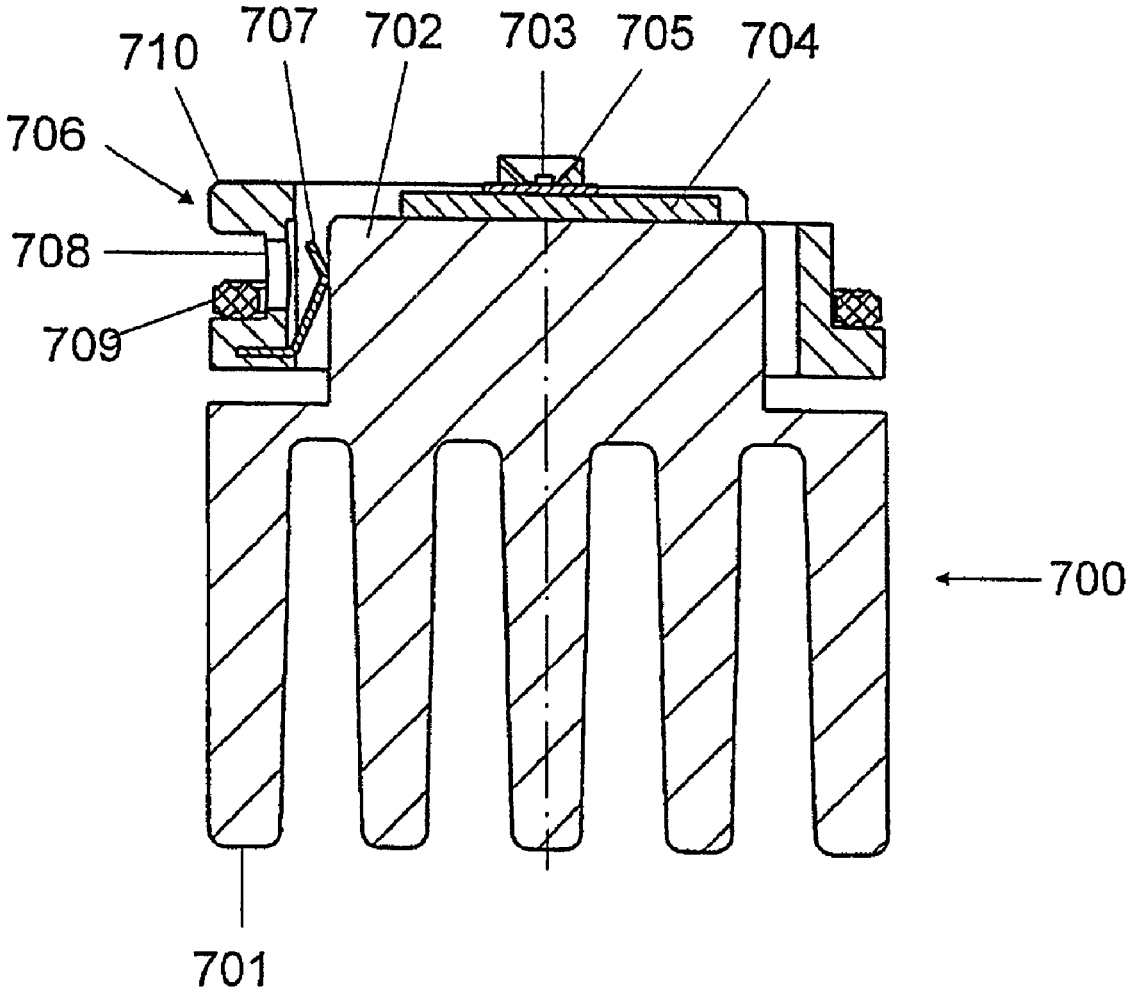
Figure 8:
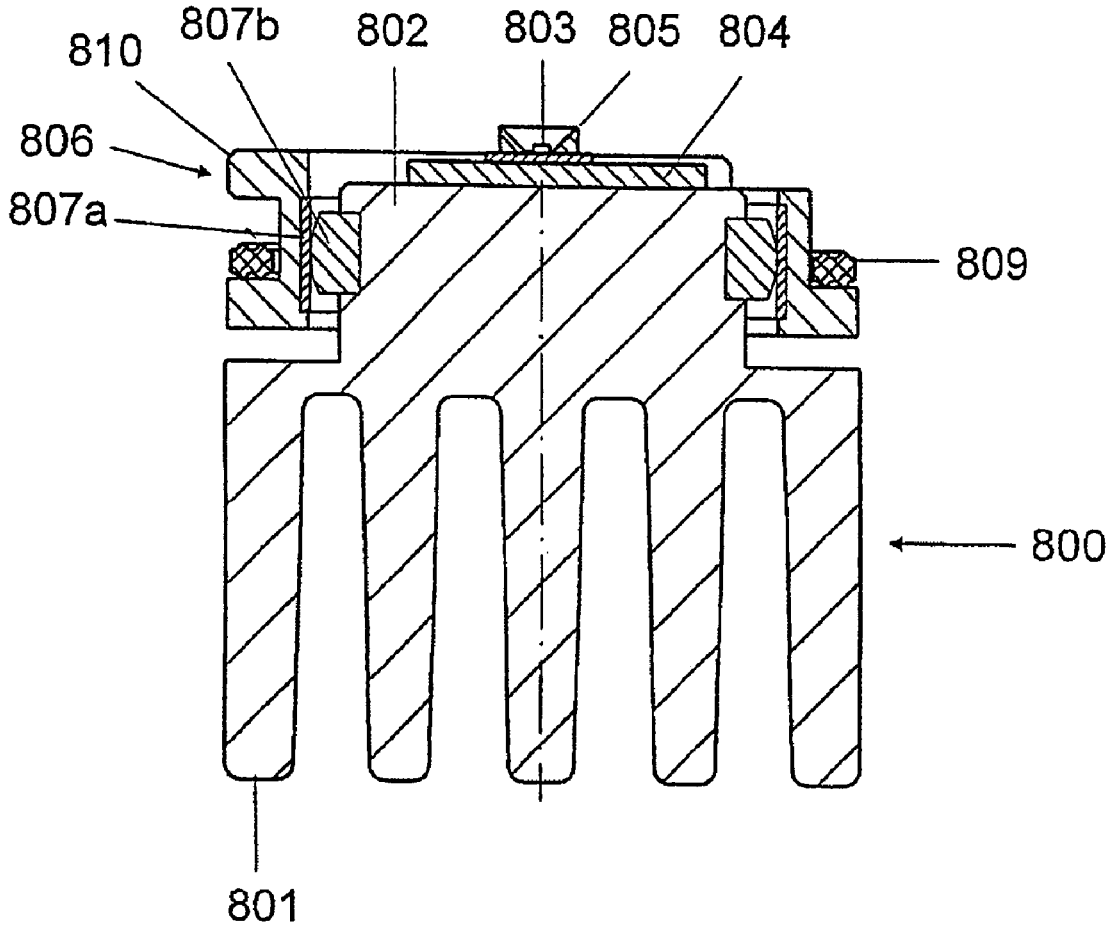

The invention will be explained in more detail below with reference to a few preferred exemplary embodiments. In the drawing:

FIG. 1 shows a plan view of the front of an illumination device in accordance with the first exemplary embodiment of the invention, FIG. 2 shows a plan view of the rear of the illumination device in accordance with the first exemplary embodiment of the invention, FIG. 3 shows an illustration of the mounting opening in the vehicle headlight which matches the exemplary embodiments depicted in FIGS. 1, 2, 5 and 6, FIG. 4 shows a side view of an illumination device in accordance with the second exemplary embodiment of the invention, FIG. 5 shows a side view of an illumination device in accordance with the third exemplary embodiment of the invention, FIG. 6 shows a plan view of the rear of the illumination device in accordance with the third exemplary embodiment of the invention, FIG. 7 shows a cross section through an illumination device in accordance with the fourth exemplary embodiment of the invention, and FIG. 8 shows a cross section through an illumination device in accordance with the fifth exemplary embodiment of the invention.

FIGS. 1 and 2 show the illumination device in accordance with the first exemplary embodiment. This illumination device has a heat sink 1 having a mounting surface 10 in the form of a circular disk and parallel cooling ribs 11, 12, 13, 14, 15, 16 which extend perpendicularly with respect to the mounting surface 10. The heat sink 1 is in the form of an integral aluminum die-cast part. The outer contour of the heat sink 1 essentially corresponds to that of a circular cylinder, apart from the cavities between the cooling ribs 11 to 16 and the latching tabs 17, 18, 19, which are part of a bayonet-type lock between the illumination device and a vehicle headlight. The three latching tabs 17, 18, 19 are arranged equidistantly along the circumference of the circular-cylindrical mounting surface 10 at a distance of 120 degrees. They point radially outwards. The two latching tabs 17, 18 have the same design but are arranged in mirror-symmetrical fashion with respect to the diameter of the mounting surface 10, which runs centrally through the third latching tab 19. The latching tab 19 has a different shape than the first latching tab 17 and the second latching tab 18 in order to ensure a definite orientation and installed position of the illumination device in the vehicle headlight. The two cooling ribs 11 and 16 arranged outside have a profile 11*a* or 16*a* on their outer surface in order to ensure that they can be gripped better on actuation of the bayonet-type lock. Next to the latching tab 19, the mounting surface 10 has a depression 102 in order to provide space for mounting a lateral contact-pressure spring 103, which acts perpendicularly with respect to the axis of the rotary movement of the bayonet-type lock. The contact-pressure spring 103 is arranged between the latching tab 19 and the spring ring 101. It is hidden in the illustration in FIG. 1 by the latching tab 19.

A carrier plate 2, for example a so-called metal-core printed circuit board, for in total five light-emitting diode chips 3 (also referred to as LED chips) is fixed on the mounting surface 10 of the heat sink 1. The metal-core printed circuit board 2 is a metal plate which is provided with electrical insulation, for example made from ceramic. Conductor tracks 21 are arranged on the electrical insulation of the metal-core printed circuit board 2 for the purpose of making electrical contact with the LED chips 3. The carrier plate or metal-core printed circuit board 2 ensures electrical insulation between the metallic heat sink 1 and the LED chips 3. The carrier plate 2 is anchored, for example mechanically, on the mounting surface 10 of the heat sink 1 by means of a clamping fit in a cutout in the heat sink 1 or by means of a latching connection or with the aid of an adhesive compound. In order to align and mount the carrier plate 2 in the correct position on the mounting surface 10 of the heat sink 1, two holes, for example, can be introduced into the mounting surface 10, in each case one appropriately shaped pin on the underside of the carrier plate 2 engaging in said holes. These holes can also define the alignment and installed position of the carrier plate 2 with respect to the latching tabs 17 to 19. The five light-emitting diode chips 3 are arranged in a row on the carrier plate 2 and are surrounded by the walls of a so-called casting trough 4 such that the row comprising the five light-emitting diode chips 3 is arranged on the bottom of the casting trough 4. The casting trough 4 is partially filled with a transparent casting compound covering the light-emitting diode chips 3 which contains, for example, two different fluorescent materials in order to convert the wavelength of some of the electromagnetic radiation generated by the light-emitting diode chips 3 such that the illumination device emits white light during its operation. Such fluorescent materials are described, for example, in WO 98/12757. The surface 4*a*, which faces the light-emitting diode chips 3, of the walls of the casting trough 4 is designed such that they reflect the electromagnetic radiation emitted by the light-emitting diode chips 3. The light-emitting diode chips 3 are, for example, thin-film light-emitting diode chips, whose basic principle is described, for example, in the document I. Schnitzer et al., Appl. Phys. Lett. 63 (16), Oct. 18, 1993, 2174-2176. The five light-emitting diode chips 3 form, together with the casting compound and the fluorescent materials integrated therein, five light-emitting diodes. The term light-emitting diode also includes those diodes which, during operation, emit electromagnetic radiation from the ultraviolet or infrared wavelength range which is converted into electromagnetic radiation from the visible wavelength range by suitable conversion means.

The carrier plate 2 has four holes 22, in each case one appropriately matching pin 52 of primary optics 5 (depicted in FIG. 4), which serve the purpose of reducing the divergence of the electromagnetic radiation emitted by the light-emitting diode chips 3, or a holder for the primary optics 5 engaging in said holes 22. As a result, the primary optics 5 are fixed on the carrier plate 2 by means of the pins 52 and its installed position and orientation with respect to the carrier plate 2 and thus also with respect to the latching tabs 17 to 19 is fixed. The holes 22 are preferably arranged such that they fit over corresponding holes in the mounting surface 10 of the heat sink 1 such that the pins 52 of the primary optics 5 are passed through the holes 22 in the carrier plate 2 and engage in the abovementioned holes in the heat sink 1. As a result, in addition to the primary optics 5, the carrier plate 2 is also fixed to the heat sink 1 and aligned by means of the aligning pins 52. In this case, no separate means are required for the carrier plate 2 for the purpose of fixing it on the mounting surface 10 of the heat sink 1. In order to set the distance of the primary optics 5 above the light-emitting diode chips 3 located therebeneath to the correct value, one or more spacers can be provided between the primary optics 5 and the carrier plate 2 or the mounting surface 10, said spacers limiting the penetration depth of the pins 52 in the holes 22. The primary optics are a compound optical concentrator which is of similar design to the optical concentrator 5 of the exemplary embodiment of the invention depicted in FIG. 4. One end of this optical concentrator 5 engages in the casting trough 4 and is coupled optically to the light-emitting diode chips 3 by means of Canada balsam, for example. The optical concentrator 5 focuses the light generated by the light-emitting diode chips 3 such that it emerges from the end side 51, which is remote from the light-emitting diode chips 3, of the concentrator 5 with reduced divergence. The optical concentrator 5 is, for example, a compound parabolic concentrator (CPC) or a compound elliptic concentrator (CEC) or a compound hyperbolic concentrator (CHC). The primary optics 5 are arranged in a well defined position and orientation with respect to the light-emitting diode chips 3 on the heat sink 1 or on the carrier plate 2. The primary optics 5 match the optics of the vehicle headlight (secondary optics).

The electrical components required for operating the light-emitting diode chips 3 are arranged on a mounting plate 6 in the form of a lead frame. The mounting plate 6 fitted with the abovementioned electrical components (not depicted) is arranged and fixed in an appropriate cutout in the central cooling rib 14. The electrical components mounted on the mounting plate 6 protrude into the intermediate space between the mounting plate 6 and the adjacent cooling ribs 13 and/or 15. In addition, the electrical connection 7 of the illumination device is mounted on the mounting plate 6. The electrical connection 7 is in the form of a socket having four contact pins 71 which is provided for the purpose of receiving a plug matching it. Two of the contact pins 71 serve the purpose of supplying power to the series-connected light-emitting diode chips 3 and two other contact pins 71 serve the purpose of supplying the voltage to a temperature sensor. The electrical components arranged on the mounting plate 6 are supplied with electrical energy by means of the socket 7. The power supply circuit, comprising the abovementioned electrical components, of the light-emitting diode chips 3 is electrically conductively connected to the light-emitting diode chips 3 by means of power supply lines (not depicted) which are passed through the aperture 100 in the mounting surface 10 and with which contact is made with the conductor tracks 21 on the carrier plate 2.

FIG. 3 shows a schematic of a holder 30 for the exemplary embodiments of the illumination device according to the invention depicted in FIGS. 1, 2, 5, 6, 7 and 8. This holder 30 is part of the vehicle headlight and is located, for example, on the rear of the vehicle headlight reflector which is remote from the light exit opening of the vehicle headlight reflector. For example, a holder 30 having the mounting opening 300 illustrated in FIG. 3 may be provided on the rear of the abovementioned reflector. The rim of the mounting opening 300 is provided with appropriate cutouts 301, 302, 303 for the latching tabs 17, 18, 19 of the illumination device. In addition, a stop 304 for the latching tab 19 and a ramp 305 are arranged at the rim of the mounting opening 300. The mounting opening 300 with the cutouts 301 to 303 and the stop 304 as well as the ramp 305 form, together with the latching tabs 17 to 19, a bayonet-type lock between the illumination device and the holder 30 of the vehicle headlight. In order to actuate the bayonet-type lock, the illumination device is plugged with its mounting surface 10, which forms the front side of the illumination device protruding into the reflector of the vehicle headlight, onto the holder 30, the latching tab 19 engaging in the cutout 303, the latching tab 17 engaging in the cutout 301 and the latching tab 18 engaging in the cutout 302, and the front side 10 of the illumination device including the latching tabs 17 to 19 passing through the mounting opening 300 such that the rear of the holder 30 bears against the spring ring 101 on the heat sink 1. Owing to a rotary movement, the illumination device is rotated with respect to the section 30 through approximately a quarter rotation such that the latching tab 19 slides over the ramp 305 and bears against the stop 304. The stop 304 prevents a further rotary movement in the screw-in direction. The ramp 305 makes a rotary movement more difficult in the unscrewing direction and prevents automatic unlatching of the bayonet-type lock. The contact-pressure spring 103 bears against the rim of the mounting opening 300 with a clamping fit in the region between the stop 304 and the ramp 305. Owing to the spring action of the contact-pressure spring 103, the illumination device is pressed against the rim regions 306, 307, which run obliquely with respect to one another, of the mounting opening such that the illumination device is supported on three sections of the rim of the mounting opening 300 and is thus secured against movements in the flange plane. The holder 30 or the rim of the mounting opening 300 is arranged with a clamping fit between the latching tabs 17 to 19 and the spring ring 101 in the latched state of the bayonet-type lock. The three latching tabs 17 to 19 lie in a common plane which forms a reference plane for the alignment of the light-emitting diode chips 3 and the primary optics 5 on the reflector of the vehicle headlight. This means that the alignment of the light-emitting diode chips 3 and the primary optics 5 with respect to the heat sink 1 ensures, in conjunction with the above-described bayonet-type lock between the holder 30 and the illumination device according to the invention, a clearly defined installed position of the light source or light sources in the vehicle headlight.

FIG. 4 illustrates an illumination device in accordance with a second exemplary embodiment of the invention. This illumination device has a heat sink 400 having a mounting surface 401 in the form of a circular disk and parallel cooling ribs 402 which extend perpendicularly with respect to the mounting surface 401. The heat sink 400 is in the form of an integral aluminum die-cast part. The outer contour of the heat sink 400 essentially corresponds to that of a circular cylinder, apart from the cavities between the cooling ribs 402. Three depressions 403 in the surface of the heat sink 400 are arranged along a circle on the mounting surface 401 at an angular distance of 120 degrees. These depressions 403 are part of a bayonet-type lock between the illumination device and the vehicle headlight, into which the illumination device is inserted. One of the three depressions 403 has a shape which is different than the shape of the two other depressions 403 in order to fix a defined installed position in a holder of the vehicle headlight for the illumination device. Three carrier plates 404, 405, 406 for in each case five light-emitting diode chips (also referred to as LED chips) are fixed on the mounting surface 401. The carrier plates 404, 405, 406 are arranged in a row such that in total fifteen light-emitting diode chips are arranged in a row on the front 401 of the heat sink 400. The two outer carrier plates 404, 406 are in each case mounted on a slope of the mounting surface 401 of the heat sink 400. As is described in the first exemplary embodiment (FIG. 1), the light-emitting diode chips are arranged in a casting trough 407 and are hidden in the illustration in FIG. 4 by the primary optics 5. The primary optics 5 have two or more integrally formed journals or aligning pins 52, by means of which it is anchored in holes in the heat sink 400. The primary optics 5 engage in the casting troughs 407, are optically coupled to the light-emitting diode chips arranged in the casting troughs 407, and their physical position and alignment is adjusted with respect to the carrier plates 404 to 406 by means of the journals or aligning pins 52. The light generated by the light-emitting diodes emerges from the light exit opening 51 of the primary optics 5 with reduced divergence. The electrical components for operating the light-emitting diode chips are mounted on a mounting plate 408 in the form of a lead frame which is arranged in a cutout in the heat sink 400 in the region of the mounting surface 401. The mounting plate 408 covers the abovementioned cutout in the heat sink 400. It is practically in the form of a lid for this cutout. The electrical components are mounted on the underside of the mounting plate 408 such that the electrical components protrude into the cutout. In the illustration in FIG. 4, the upper side of the mounting plate 408 can be seen. The depth of the abovementioned cutout matches the physical height of the electrical components mounted on the mounting board 408. An electrical connection, in the form of a socket 409, of the illumination device is arranged in a second cutout at the edge of the mounting surface 401. The electrical components mounted on the mounting plate 408 are supplied with electrical energy via the contact pins of the socket 409. The circuit arrangement formed by the electrical components on the mounting plate 408 serves the purpose of supplying power to the light-emitting diode chips. Electrical contacts 410 are provided at that edge of the mounting plate 408 which faces the carrier plates 404, 405, 406 for the purpose of making contact with the light-emitting diode chips arranged on the carrier plates 404 to 406.

The primary optics 5 of the illumination device match the downstream secondary optics of the vehicle headlight. The secondary optics may be a reflector, for example a free-form surface reflector, an optical lens system or a combination of an optical lens system and a reflector.

FIGS. 5 and 6 illustrate a third exemplary embodiment of the illumination device according to the invention. This illumination device is largely identical to the illumination device in accordance with the first exemplary embodiment, which is depicted in FIGS. 1 and 2. The same references are therefore also used in the corresponding FIGS. 1 and 2 and 5 and 6 for identical parts of the two exemplary embodiments. For the description of these parts, reference is made to the description of the corresponding parts of the first exemplary embodiment. The illumination device in accordance with the third exemplary embodiment differs from that in accordance with the first exemplary embodiment only by the different design of the electrical connection 7'. The electrical connection 7' of the illumination device is mounted on the mounting plate 6. It has four metallic contact webs 71' which are arranged in the cavity between the cooling ribs 13 and 14 and extend in the radial direction of the essentially circular-cylindrical heat sink 1. In particular, the contact webs 71' run parallel to the cooling ribs 11 to 16 and protrude beyond the coolings ribs 11 to 16 such that the free ends of the contact webs 71' protrude from the heat sink 1. When the illumination device is mounted in the mounting opening 300 in the holder 30 (FIG. 3), i.e. during the latching of the bayonet-type lock, the contact webs 71' are rotated into the contact-making position with their opposing contacts on the vehicle headlight. Owing to the latching of the bayonet-type lock, the electrical contact between the illumination device and the supply system voltage of the vehicle is thus also produced. When the bayonet-type lock is unlatched, the electrical contact for power supply purposes is accordingly also automatically interrupted.

FIG. 7 illustrates the illumination device in accordance with the fourth exemplary embodiment of the invention, in a sectioned side view. This illumination device largely corresponds to that of the first exemplary embodiment. It differs from the first exemplary embodiment only by the fact that the heat sink 700 does not have any integrally formed latching tabs, but instead a fixing ring 706 is provided which is equipped with the three latching tabs 710 of the bayonet-type lock. One of the three latching tabs 710 has the same shape as the latching tab 19 depicted in FIG. 1, while the other two latching tabs 710 have the shape of the latching tabs 17 and 18 depicted in FIG. 1. The heat sink 700 is made from a metal having a high thermal conductivity, for example from an aluminum die-cast part, and has two or more cooling ribs 701 and a circular-cylindrical section 702 to which the fixing ring is fixed with the aid of three welding tabs 707 distributed evenly along the circumference of the ring. The fixing ring 706 is made from, for example, plastic, in which one end of the welding tabs 707 is embedded, while the other end of the welding tabs 707 is welded to the circular-cylindrical section 702 of the heat sink 700. The fixing ring 707 is also equipped with a spring ring 709 and a lateral contact-pressure spring 708, which has the same function as the spring ring 101 depicted in FIG. 5 and the contact-pressure spring 103. A carrier plate 704 with light-emitting diode chips 703 and a casting trough 705 surrounding the light-emitting diode chips 703 are arranged on the mounting surface of the heat sink 700. In addition, primary optics 5 (depicted in FIG. 4) are arranged above the light-emitting diode chips 703 on the heat sink 700 and are optically coupled to the light-emitting diode chips 703. The fixing ring 706 provides additional adjustment possibilities, as has already been explained above. After the adjustment, the fixing ring 706 is fixed in the desired position and alignment by means of welding of the welded lugs 707 to the circular-cylindrical heat sink section 702. The three latching tabs 710 of the fixing ring 706 form, together with the appropriate cutouts 301 to 303 at the rim of the mounting opening 300 in the holder 30 depicted in FIG. 3, a bayonet-type lock.

FIG. 8 illustrates the illumination device in accordance with the fifth exemplary embodiment of the invention, in a sectioned side view. This illumination device largely corresponds to that of the fourth exemplary embodiment. It differs from the fourth exemplary embodiment only by the manner in which the fixing ring 806 is fixed to the heat sink 800. The heat sink 800 is made from a metal having a high thermal conductivity, for example from an aluminum die-cast part, and has two or more cooling ribs 801 and a circular-cylindrical section 802, to which the fixing ring 806 is fixed with the aid of a metal ring 807*a*, which is embedded in the fixing ring 806 made from plastic, and a plastic ring 807*b*, which is arranged in an annular groove in the circular-cylindrical heat sink section 802. In order to fix the fixing ring 806 to the heat sink 800 in the desired position and alignment, after the adjustment, a current flow is brought about in the metal ring 807*a* by means of electromagnetic induction, and this current flow heats the metal ring 807*a* such that the plastic ring 807*b* bearing against it melts. The current flow is only maintained for a short period of time such that the plastic of the plastic ring 807*b* immediately cures again and then a form-fitting connection is produced between the fixing ring 806 and the heat sink section 802. The fixing ring 806 is equipped with the three latching tabs 810 of the bayonet-type lock. One of the three latching tabs 810 has the same shape as the latching tab 19 depicted in FIG. 1, while the other two latching tabs 810 have the shape of the latching tabs 17 and 18 depicted in FIG. 1. The three latching tabs 810 of the fixing ring 806 form, together with the appropriate cutouts 301 to 303 at the rim of the mounting opening 300 in the holder 30 depicted in FIG. 3, a bayonet-type lock. The fixing ring 806 is also equipped with a spring ring 809 and a lateral contact-pressure spring which has the same function as the spring ring 101 depicted in FIG. 5 and the contact-pressure spring 103. A carrier plate 804 with light-emitting diode chips 803 and a casting trough 805 surrounding the light-emitting diode chips 803 are arranged on the mounting surface of the heat sink 800. In addition, primary optics 5 (depicted in FIG. 4) are also arranged above the light-emitting diode chips 803 on the heat sink 800 and are optically coupled to the light-emitting diode chips 803. The fixing ring 806 offers additional adjustment possibilities, as has already been explained above.

The invention is not restricted to the exemplary embodiments explained in more detail above. For example, light-emitting diodes emitting infrared radiation can also be used instead of the light-emitting diodes emitting white light in order to use such an illumination device, for example for the purpose of producing an infrared upper beam, in a vehicle headlight. In addition, light-emitting diodes emitting colored light can also be used in order to use the illumination device as a light source in rear lights in the vehicle, for example as a reversing light, a braking light or an indicator etc. In addition, the illumination device according to the invention can also be used as a light source in other luminaires, which require adjustment of the light source with respect to an optical system of the luminaire.

The latching tabs need not necessarily be arranged in a common plane, as is described in the preferred exemplary embodiments. Instead, they can also be arranged in different planes in order to make it possible, for example, in a simple manner to code different types of illumination devices. The number and design of the latching tabs can likewise be varied in order to make it possible to code different types of illumination devices. The abovementioned coding can also be ensured by a different design and physical arrangement of the contact webs 71 and 71' of the electrical connection 7 and 7', respectively.

Cooling of the illumination device according to the invention or the vehicle headlight according to the invention can be assisted, for example, with the aid of a fan or blower. The illumination device according to the invention or the vehicle headlight according to the invention can, in addition or instead, also comprise a Peltier element for the purpose of assisting the cooling, whose cold surface is thermally coupled, for example, to the carrier plate of the light-emitting diode chips, and whose warm surface is thermally coupled to the heat sink. This means that a smaller heat sink can be used.

The invention claimed is:

1. An illumination device having at least one light-emitting diode and a heat sink for the purpose of cooling the at least one light-emitting diode, wherein said heat sink is provided with latching means which serve the purpose of forming a bayonet-type lock with a holder for the illumination device, said latching means comprise at least two latching tabs which are arranged on a circular arc; and wherein a spring ring is provided which acts as an opposing bearing with respect to said latching tabs (17, 18, 19; 710; 810) when the bayonet-type lock is latched.

2. The illumination device as claimed in claim 1, wherein the illumination device is provided with an optical means, coupled to the at least one light-emitting diode, for the purpose of reducing the divergence of the electromagnetic radiation emitted by the at least one light-emitting diode, the optical means being arranged in a defined position and alignment with respect to the latching means arranged on the heat sink.

3. An illumination device having at least one light-emitting diode and a heat sink for the purpose of cooling the at least one light-emitting diode, wherein said heat sink is provided with latching means which serve the purpose of forming a bayonet-type lock with a holder for the illumination device, wherein the illumination device has an electrical connection having at least one metallic contact web which extends perpendicularly with respect to the axis of the rotary movement of the bayonet-type lock, with the result that, owing to the rotary movement when the bayonet-type lock is latched or unlatched, the electrical contact between the at least one contact web and its opposing contact is produced or released.

4. A vehicle headlight having at least one illumination device which has at least one light-emitting diode and a heat sink for the at least one light-emitting diode, and having light-deflecting means for the light generated by the at least one illumination device, the at least one illumination device being arranged in a holder of the vehicle headlight, wherein said heat sink is provided with first latching means which, together with second latching means on the holder, form a bayonet-type lock; and wherein said first latching means comprise at least two latching tabs (17, 18, 19; 710; 810) which are arranged along a circular arc, and the second latching means comprise a mounting opening (300) in the holder, whose rim has appropriate cutouts (301, 302, 303) for the at least two latching tabs (17, 18, 19; 710; 810), and the second latching means (300, 301, 302, 303, 304) comprise a stop (304) for at least one of the latching tabs (19), which stop (304) serves the purpose of limiting the rotary movement when the bayonet-type lock is latched.

5. The vehicle headlight as claimed in claim 4, wherein the second latching means comprise a ramp-shaped web at the rim of the mounting opening.

6. A vehicle headlight having at least one illumination device which has at least one light-emitting diode and a heat sink for the at least one light-emitting diode, and having light-deflecting means for the light generated by the at least one illumination device, the at least one illumination device being arranged in a holder of the vehicle headlight, wherein said heat sink is provided with first latching means which, together with second latching means on the holder, form a bayonet-type lock; and wherein the at least one illumination device is provided with an electrical connection which has at least one contact web which extends perpendicularly with respect to the axis of the rotary movement of the bayonet-type lock, with the result that, owing to the rotary movement when the bayonet-type lock is latched or unlatched, the electrical contact between the at least one contact web and an opposing contact on the vehicle headlight is produced or released.

7. The vehicle headlight as claimed in claim 6, wherein the at least one illumination device is provided with an optical means, coupled to the at least one light-emitting diode, for the purpose of reducing the divergence of the electromagnetic radiation emitted by the at least one light-emitting diode, the optical means being arranged in a defined position and alignment with respect to the light-deflecting means.

8. The illumination device as claimed in claim 1, wherein the at least one latching tab (19) has a shape which is different than the shape of the other latching tabs.

9. An illumination device having at least one light-emitting diode and a heat sink for the purpose of cooling the at least one light-emitting diode, wherein said heat sink is provided with latching means which serve the purpose of forming a bayonet-type lock with a holder for the illumination device, wherein said latching means comprise at least two latching tabs which are arranged along a circular arc; and said latching tabs are integrally formed on a section of the heat sink with a circular-cylindrical geometry; and wherein a spring ring is provided which acts as an opposing bearing with respect to the latching tabs when the bayonet-type lock is latched.

10. The illumination device as claimed in claim 1, wherein the at least one light-emitting diode is arranged in a defined position and alignment with respect to the latching means arranged on the heat sink.

11. The illumination device as claimed in claim 9, wherein the illumination device is provided with an optical means, coupled to the at least one light-emitting diode, for the purpose of reducing the divergence of the electromagnetic radiation emitted by the at least one light-emitting diode, the optical means being arranged in a defined position and alignment with respect to the latching means arranged on the heat sink.

* * * * *